United States Patent [19]

Peters et al.

[11] Patent Number: 4,840,885

[45] Date of Patent: Jun. 20, 1989

[54] COLOR PHOTOGRAPHIC RECORDING MATERIAL FOR THE DYE DIFFUSION TRANSFER PROCESS

[75] Inventors: Manfred Peters, Leverkusen; Günter Helling, Odenthal; Helmut Reiff, Leverkusen, all of Fed. Rep. of Germany

[73] Assignee: Agfa-Gevaert Aktiengessellschaft, Leverkusen, Fed. Rep. of Germany

[21] Appl. No.: 162,618

[22] Filed: Mar. 1, 1988

[30] Foreign Application Priority Data

Mar. 14, 1987 [DE] Fed. Rep. of Germany ..... 3708307

[51] Int. Cl.[4] ..... G03C 5/54; G03C 7/26

[52] U.S. Cl. ..... 430/559; 430/203; 430/215; 430/222; 430/545; 430/627

[58] Field of Search ..... 430/203, 222, 545, 627, 430/215, 559

[56] References Cited

U.S. PATENT DOCUMENTS

| | | | |
|---|---|---|---|
| 3,619,195 | 11/1971 | Van Campen | 430/545 |
| 4,203,716 | 5/1980 | Chen | 430/222 |
| 4,368,258 | 1/1983 | Fujiuhara et al. | 430/222 |
| 4,430,415 | 2/1984 | Aono et al. | 430/203 |
| 4,689,286 | 8/1987 | Schranz et al. | 430/203 |
| 4,751,175 | 6/1988 | Aotsuka et al. | 430/203 |

*Primary Examiner*—Richard L. Schilling

*Attorney, Agent, or Firm*—Connolly & Hutz

[57] ABSTRACT

A color photographic recording material for the dye diffusion transfer process contains color producing compounds in the form of a dispersion of particles of an ionically modified polyaddition or polycondensation product containing from 4 to 180 milliequivalents of ionic groups per 100 g, which particles are charged or loaded with the color producing compound. When development is carried out by heat treatment, color transfers with high maximum densities and low minimum densities are obtained.

7 Claims, No Drawings

COLOR PHOTOGRAPHIC RECORDING MATERIAL FOR THE DYE DIFFUSION TRANSFER PROCESS

This invention relates to a colour photographic recording material having at least one layer of binder applied to a layer support, which binder contain light-sensitive silver halide and a non-diffusible color providing compound which is present in the layer of binder in the form of a dispersion of particles of an ionically modified polymer which is charged or loaded with the color providing compound.

The invention particularly relates to a colour photographic recording material which contains at least one color providing compound in the form of the above mentioned dispersion and is developable by heat treatment.

Heat developable photographic recording materials containing silver halide emulsions as light-sensitive additives have already been described. A survey of the use of silver halide emulsions for thermographic processes in hydrophilic and hydrophobic media is given, for example, in Research Disclosure 17029 (June 1978). In such processes the silver halide may not only serve to form the latent image but may in addition contribute to the formation of the image as metallic silver or serve as oxidizing agent for the subsequent colour reactions. The color providing compounds used may be inter alia conventional colour couplers or leuco dyes which produce a colour image in oxidation.

Particularly suitable color providing compounds are those which can be incorporated in the layer of a photographic material in a non-diffusible form and are capable of releasing a diffusible dye as a result of development (dye releasing compounds). The special suitability of such dye releasing compounds is due to the fact that the dyes which have been released imagewise can be transferred to special image receptor layers to form a brilliant colour image there which is not impaired by any superimposed image silver or silver halide and therefore requires no after-treatment. An advantageous rapid process for the production of colour images is therefore obtained by a combination of the heat development process with the dye diffusion process. A suitable recording material for this purpose is described, for example, in EP-A-No-O 123 913.

According to the aforesaid publication, a recording material having a layer which contains a combination of silver halide, silver benzotriazolate, a dye releasing compound and guanidine trichloroacetate (base donor) is exposed imagewise and then subjected to a heat treatment in contact with an image receptor sheet so that the dye which has been released imagewise is transferred to the image receptor sheet. The production of multicoloured images requires several such combinations and the silver halide in each of these combinations is required to be sensitive to a different spectral region of light and is associated with a dye releasing compound which corresponds to its particular spectral sensitivity and releases a dye of a different colour, in most cases a colour which is complementary to the colour of the light to which the associated silver halide is predominantly sensitive. Such associations may be arranged in different layers one above the other.

Dye releasing compounds are generally introduced into photographic layers by means of high boiling solvents, so-called oil formers. Compounds conventionally used for this purpose include inter alia phosphoric acid esters (e.g. tricresyl phosphate), phthalic acid esters (e.g. dibutylphthalate), benzoic acid esters (e.g. octylbenzoate) and alkylamides (e.g. diethyllauramide). For preparing dispersions of dye releasing compounds, the dye releasing compound is first dissolved in a low boiling auxiliary solvent, and the oil former may be added either immediately or later. The resulting solution is then dispersed in an aqueous colloid solution, whereupon the auxiliary solvent is removed, e.g. by distillation.

This process requires technically elaborate apparatus for emulsification and considerable labour for the preparation of fine dispersions. Even then, the particle size and the range of distribution are in many cases unsatisfactory. Another problem is that dispersions prepared in this manner with gelatine have only a limited storage life and require refrigeration conditions for storage. Although development with such dye releasing dispersions in recording materials which can be developed by heat can produce quite good results, the minimum densities and maximum densities obtainable are in many cases unsatisfactory.

It is an object of the present invention to provide a colour photographic recording material which enables coloured transfer images to be obtained with low fog values and high maximum densities, the colour photographic recording material being in particular one which can be developed by heat treatment.

The present invention thus relates to a colour photographic recording material comprising at least one layer of binder applied to a layer support, which binder contains light sensitive silver halide and at least one non-diffusible color providing compound which is capable of releasing a diffusible dye as a result of development by heat treatment, characterised in that the color providing compound is contained in the layer of binder in the form of a dispersion of particles of an ionically modified polymer which is charged with the color providing compound. The said dispersion of color providing compounds is particularly suitable for use in colour photographic recording materials which may be developed by heat treatment.

One important component of the recording material according to the invention is therefore a non-diffusible color providing compound, namely a compound which under the conditions of development gives rise to an imagewise distribution of diffusible dyes which depends on the conditions previously employed for exposure. According to the invention, this color providing compound is present in at least one layer of binder of the colour photographic recording material in the form of a dispersion of particles of an ionically modified polymer which is charged with the color providing compound. The ionically modified polymers are mainly inonomeric polyaddition or polycondensation products.

The ionomeric polyaddition or polycondensation products used according to the invention contain, per 100 g of product, from 4 to 180 milliequivalents, preferably from 4 to 100 milliequivalents of ionic groups or groups capable of conversion into ionic groups and optionally from 1 to 20% by weight of alkylene oxide units of the formula $—CH_2—CH_2—O—$ incorporated within a polyether chain which may be either present in a side chain or contained in the main chain.

The types of compounds which are suitable for use as ionomeric polyaddition or polycondensation products according to the invention, hereinafter referred to as "ionomeric products", include polyurethanes, polyesters, polyamides, polyureas, polycarbonates, polyacetals and polyethers as well as other ionomeric products which belong to two or more types of polymers, e.g. polyester polyurethanes, polyether polyurethanes or polyesterureas.

Ionomeric products of the type used according to the invention are known per se and have been described, for example, in Angewandte Makromolekulare Chemie 26 (1972), pages 45 to 106; Angewandte Chemie 82 (1970), pages 53 et seq; and J. Oil. Col. Chem. Assoc. 53 (1970), page 363. Other descriptions of suitable inonomeric products may be found in German Offenlegungsschriften (DE-A-) Nos. 2 637 690, 2 642 973, 2 651 505, 2 651 506, 2 659 617, 2 729 345, 2 730 514, 2 732 131, 2 734 576 and 2 811 148.

Ionomeric products which have anionic groups are preferred. Ionomeric products which are particularly suitable for the process of the invention are described in DE-B2 No.-1 472 746. These ionomeric products are based on polyurethanes obtained from compounds with molecular weights of from 300 to 10,000 containing several reactive hydrogen atoms, polyisocyanates and optionally chain-extending agents containing reactive hydrogen atoms. Any isocyanate groups still present in these polyurethanes are reacted either during their preparation or subsequently with a compound which contains at least one active hydrogen atom and at least one salt-type group or group capable of salt formation. When the compounds used for the reaction contain groups which are capable of salt formation, the resulting anionic polyurethanes are subsequently at least partly converted into the salt form in known manner.

By "salt-type groups" are meant particularly $—SO_3^-$ groups and $—COO^-$ groups.

The following compounds are examples of suitable starting components for the preparation of the anionic polyurethanes:

I.

Compounds containing active hydrogen atoms

These compounds are substantially straight chained and have a molecular weight of about 300 to 10,000, preferably 500 to 4,000. The compounds, which are known per se, have terminal hydroxyl and/or amino groups. Polyhydroxyl compounds such as polyesters, polyacetals, polyethers, polyamides and polyester amides are preferred. The hydroxyl number of these compounds is approximately in the range of from 370 to 10, in particular from 225 to 28.

Suitable polyethers include, for example, the polymerisation products of ethylene oxide, propylene oxide, tetrahydrofuran and butylene oxide and their copolymerisation or graft polymerisation products as well the condensates obtained by the condensation of polyhydric alcohols or mixtures thereof and the products obtained by the alkoxylation of polyhydric alcohols.

Suitable polyacetals include, for example, the compounds obtainable from hexanediol and formaldehyde. Suitable polyesters, polyester amides and polyamides include the predominantly linear condensates obtained from polybasic, saturated carboxylic acids and polyvalent saturated alcohols, amino alcohols, diamines or mixtures thereof.

Polyhydroxyl compounds already containing urethane or urea groups and modified or unmodified natural polyols such as castor oil or carbohydrates may also be used.

The various polyhydroxyl compounds may, of course, be used as mixtures in order to vary the lyophilic or hydrophobic character and mechanical properties of the products of the process.

II.

Polyisocyanates

The polyisocyanates may suitably by any aromatic or aliphatic diisocyanates, e.g. 1,5-naphthylene diisocyanate, 4,4'-diphenylmethane diisocyanate, 4,4'-diphenyldimethylmethane diisocyanate, di- and tetraalkyl-diphenyl-methane diisocyanate, 4,4'-dibenzyl-diisocyanate, 1,3-phenylene-diisocyanate, 1,4-phenylene-diisocyanate and the isomers of tolylene-diisocyanate, optionally as mixtures, the following being preferred: Aliphatic diisocyanates, butane-1,4-diisocyanate, hexane-1,6 diisocyanate, dicyclohexylmethane-diisocyanate, cyclohexane-1,4-diisocyanate and isophorone diisocyanate.

III.

Chain-extending agents

Chain lengthening agents containing reactive hydrogen atoms include the following:

1. The usual glycols such as ethylene glycol or condensates of ethylene glycol, butanediol, propane-1,2-diol, propane-1,3-diol, neopentyl glycol, hexanediol, bis-hydroxymethylcyclohexane and dioxethyldiane;
2. aliphatic, cycloaliphatic and aromatic diamines, such as ethylene diamine, hexamethylene diamine, 1,4-cyclohexylene diamine, benzidine, diaminodiphenyl methane, the isomers of phenylenediamine, hydrazine and ammonia;
3. amino alcohols such as ethanolamine, propanolamine and butanolamine;
4. polyfunctional amines or hydroxyl compounds such as diethylenetriamine, triethylenetetramine, tetraethylenepentamine, pentaethylenehaxamine, hexaethylene-heptamine, glycerol, pentaerythritol, 1,3-diaminoiso-propanol, 1,2-diaminopropanol, and minooxalkylated polyamines such as N-oxethylethylenediamine, N-oxethylhydrazine and N-oxethylhexamethylenediamine;
5. water.

IV.

Compounds capable of salt formation

1. Compounds containing a completely formed acid group (a) Hydroxy acids such as, for example, glyceric acid, lactic acid, trichlorolactic acid, malic acid, dihydroxymaleic acid, dihydroxyfumaric acid, tartaric acid, dihydroxytartaric acid, citric acid, dimethylol propionic acid and dimethylolbutyric acid; aliphatic, cycloaliphatic, aromatic and heterocyclic mono-and diamino-carboxylic acids, such as glycine, $\alpha$- and $\beta$-alanine, 6-aminocaproic acid and 4-amino-butyric acid; the isomers of mono- and diamino-benzoic acids and the isomers of mono- and diamino-naphthoic acids;

(b) Hydroxysulphonic acid carboxysulphonic acids; 2-hydroxyethanesulphonic acid, phenolsulphonic acid-(2), phenolsulphonic acid-(3), phenolsulphonic acid-(4), phenolsulphonic acid-(2,4), sulphoacetic acid, m-sulphobenzoic acid, p-sulphobenzoic acid, benzoic acid-(1)-disulphonic acid-(3,5), 2-chlorobenzoic acid-(1)-sulphonic acid-(4), 2-hyroxy-benzoic acid-(1)-sulphonic acid-(5), naphthol-(1)-sulphonic acid, naphthol-(1)-disulphonic acid, 8-chloronaphthol-(1)-disulphonic acid, naphthol-(1)-trisulphonic acid, naphthol-(2)-sulphonic acid-(1) and naphthol-(2)-trisulphonic acid;

(c) aminosulphonic acids, amidosulphonic acid, hydroxyl-amino-monosulphonic acid, hydrazine-disulphonic acid, sulphanilic acid, N-phenylamino-methanesulphonic acid, 4,6-dichloroaniline-sulphonic acid-(2), phenylenediamine-(1,3)-disulphonic acid-(4,6), naphthylamine-(1)-sulphonic acid, naphthylamine-(2)-sulphonic acid, naphthylamine disulphonic acid, naphthylamine-trisulphonic acid, 4,4'-di-(p-aminobenzoylamine)-dipenylurea-disulphonic acid-(3,3'), phenylhydrazine-disulphonic acid-(2,5), taurine, methyltaurine, butyltaurine, 3-amino-benzoic acid-(1)-sulphonic acid-(5), 3-aminotoluene-N-methanesulphonic acid, 4,6-diaminobenzene-disulphonic acid-(1,3), 2,4-diaminotoluene-sulphonic acid-(5), 4,4'-diaminodiphenyl-disulphonic acid-(2,2'), 2-aminophenol-sulphonic acid-(4), 4,4'-diamino-diphenylether-sulphonic acid-(2), 2-amino-anisole-N-methanesulphonic acid, 2-amino-diphenyl-aminesulphonic acid, ethylene glycol sulphonic acid, 2,4-diaminobenzène sulphonic acid, and N-sulphonatoethyl-ethylenediamine;

(d) also to be included among the hydroxy and aminocarboxylic acids and sulphonic acids and polycarboxylic and sulphonic acids are the (optionally saponified) products of addition of unsaturated acids such as acrylic acid, methacrylic acid, vinylsulphonic acid or styrenesulphonic acid and unsaturated nitriles such as acrylonitrile, of cyclic dicarboxylic acid anhydrides such as maleic, phthalic or succinic acid anhydride, of sulphocarboxylic acid anhydrides such as sulphoacetic or o-sulphobenzoic acid anhydride, of lactones such as B-propio-lactone or γ-butyrolactone, or products of addition of reaction products of olefines with sulphur trioxide, such as carbyl sulphate, of epoxycarboxylic and sulphonic acids such as glycidic acid or 2,3-epoxy-propanesulphonic acid, of sultones such as 1,3-propanesultone, 1,4-butanesultone or 1,8-naphthyl-sultone, of cyclic sulphates such as glycol sulphate and of disulphonic acid anhydrides such as benzene disulphonic acid-(1,2)-anhydride to aliphatic and aromatic amines such as 1,2-ethylenediamine, 1,6-hexamethylenediamine, the isomeric phenylene diamines, diethylenetriamine, triethylenetetramine or tetraethylenepentamine and the products of addition of sodium hydrogen sulphite to olefinically unsaturated compounds such as allyl alcohol, maleic acid, maleic acid-bis-ethylene glycol ester or maleic acid-bis-propylene glycol ester; and (e) hydrazine carboxylic acids such as hydrazine dicarboxylic acids.

2. Reactive compounds with 3 to 7 ring members containing salt-type groups or groups which are capable of salt formation after ring opening:

(a) Dicarboxylic acid anhydrides such as succinic acid anhydride, maleic acid anhydride and optionally hydrogenated phthalic acid anhydride;

(b) tetracarboxylic acid dianhydrides such as 1,2,4,5-benzene tetracarboxylic acid anhydride;

(c) disulphonic acid anhydrides such as benzene disulphonic acid-(1,2)-anhydride;

(d) sulphocarboxylic acid anhydrides such as sulphoacetic acid anhydride or o-sulphobenzoic acid anhydride;

(e) sultones such as 1,3-propanesultone, 1,4-butane-sultone or 1,8-naphthosultone;

(f) lactones such as β-propiolactone or γ-butyrolactone;

(g) epoxycarboxylic acids such as glycidic acid, optionally in the form of their alkali metal salts; and (h) epoxysulphonic acids such as 2,3-epoxypropane-sulphonic acid-1, optionally in the form of their alkali metal salts, and the addition products of epoxy aldehydes and alkali metal hydrogen sulphities such as, for example, the bisulphite compound of glycidic aldehyde.

The acid groups mentioned above may be converted into the salt form in the usual manner by reaction with the compounds mentioned below:

Inorganic bases, compounds which are basic in reaction or split off bases, such as monovalent metal hydroxides, carbonates and oxides, e.g. sodium hydroxide, potassium hydroxide, sodium carbonate, potassium carbonate or sodium bicarbonate; also, organic bases such as tertiary amines, e.g. trimethylamine, triethylamine, dimethylaminoethanol, dimethylaminopropanol, ammonia and the like.

Suitable starting components also include, for example, monohydric and dihydric alcohol containing ethylene oxide units incorporated in polyether chains.

When such monofuntional, non-ionic hydrophilic polyethers are included it may often be advatageous to prevent premature chain breakage by adding starting components which have a functionality greater than 2. The monofunctional polyethers corresponding to the least mentioned general formula are prepared by known processes such as those described, for example, in US Pat. Nos. 3,905,929, 4,190,566 and 4,237,264.

Starting components of this type impart additional, pointwise hydrophilic properties, electrolyte stability, stability to freezing and improved sliding properties to the polyurethanes to be used according to the invention.

The quantity of polyisocyanates used is preferably chosen to ensure that all isocyanate reactive groups undergo reaction.

The reaction is optionally carried out in the presence of solvents, low boiling solvents with boiling points below 120° C., such as acetone, methyl ethyl ketone, acetonitrile, tetrahydrofuran and dioxane, optionally containing a certain proportion of water, being particularly suitable. Water may be used with or without the addition of organic solvents to serve as solvent for inorganic bases and compounds containing at least one isocyanate reactive hydrogen atom and at least one salt-type group or group which is capable of salt formation.

The predominantly straight chained high molecular weight anionic polyurethanes are generally obtained as clear to slightly opalescent solutions in the above mentioned polar solvents. Their solids content amounts to about 5 to 50% by weight of ionic polyurethane.

The method of preparation of the ionomeric products used according to the invention will now be illustrated by examples. Polymer 1

An isocyanate prepolymer (1.78% NCO) is prepared by reacting 800 g (0.356 mol) of a polyester of adipic acid and 1,4-butanediol (dehydrated) and 95 g (0.546 mol) of 2,4-tolylene diisocyanate for 1.5 hours at 75 to 85° C. The prepolymer is dissolved hot in 1060 g of tetrahydrofuran and a solution of 53 g (0.13 mol) of an aqueous solution of the sodium salt of N-sulphonatoethyl-ethylene diamine in 100 ml of water is added at 50° C. A further 500 g of tetrahydrofuran is added after 5 minutes owing to the steep increase in viscosity. A clear polyurethane-polyurea solution having the following characteristic data is obtained:

Solids content: 35.3%
Viscosity (24° C.): 1000 mPas
Viscosity (24° C.) of a sample of the solution adjusted to 30% with tetrahydrofuran: 400 mPas
Sulphonate group content: 14.1 equivalents/100 g Polymer 2

The procedure is as described for Polymer 1 but acetone is used instead of tetrahydrofuran as solvent. When 1060 g of acetone and 42.5 g (0.104 mol) of an aqueous solution of the sodium salt of N-sulphonatoethyl-ethylenediamine are used, a clear polyurethane-polyurea solution having a solids content of 43.6% and a viscosity of 5700 mPas (25° C.) is obtained. A solution adjusted to a solids content of 30% has a viscosity of 300 mPas (24° C.). The sulphonate group content is 14.1 m equivalents/100g.

Polymer 3

An isocyanate prepolymer (NCO =1.68%) is prepared as described for Polymer 1 from 400 g (0.178 mol) of a polyester of adipic acid and 1,4-butanediol (dehydrated) and 47.5 g (0.273 mol) of tolylene diisocyanate (65:35 isomeric mixture). The prepolymer is dissolved hot in 980 g of acetone, and an aqueous solution of 42.5 g (0.104 mol) of the sodium salt of N-sulphonatoethyl-ethylene diamine and 75 ml of water is added at 50° C. A slightly yellowish solution of a polyurethane urea is obtained.

Solids content: 30.0%
Viscosity (23° C.): 2200 mPas
Sulphonate group content: 22.2 m equivalents/100 g Polymer 4

An isocyanate prepolymer (4.11% NCO) is prepared from 500 g (1.0 mol) of a polyether based on bisphenol A and propylene oxide, 140 g (0.08 mol) of a polyester of phthalic acid, adipic acid and ethylene glycol (all dehydrated), 145 g (0.239 mol) of a 70% solution of a propoxylated adduct of butenediol and sodium bisulphite in toluene and 315 g (1.875 mol) of 1,6-disocyanatohexane by reacting the components at 100° C. for 6.5 hours. 77 g (1.283 mol) of urea are added and the reaction mixture is briefly heated to 135° C. and stirred at 130° C. until NCO can no longer be detected in the IR spectrum. 290 ml of water followed by 1582 g of acetone are then added with cooling. A clear, slightly yellowish solution of a polyurethane polyurea in acetone is obtained.

Solids Content: 40%
Viscosity (23° C.): 60 mPas
Sulphonate group content: 19 m equivalents per 100 g.

Polymer 5

2200 g (4.0 mol) of a polyether based on bisphenol A and propylene oxide and 115 g (0.053 mol) of a monofunctional polyether obtained from n-butanol, propylene oxide and ethylene oxide are dehydrated and 160 g (0.113 mol) of a 70% solution in toluene of the sodium salt mentioned in the description of Polymer 4 are added. The reaction mixture is then decomposed at 60° C. with 1096 g (6.30 mol) of tolylene diisocyanate (80:20 isomeric mixture inactivated with 20 mg of hydrogen chloride). The temperature rises to 60° C. in spite of the application of cooling means. Stirring is then continued for 5 hours at 80° C. (NCO =4.95%), the solids content is adjusted to 70% with acetone, and the mixture is reacted with 52 g (1.350 mol) of acetone ketazine.

733 ml of acetone and 95 ml of water are then added to 900 g of this solution and stirring is continued overnight at room temperature. A clear polyurethane-polyurea solution is obtained.

Solids content: 36.5%
Viscosity: 19000 mPas
Sulphonate groups content: 7.5 m equivalents per 100 g. A solution which has been diluted with acetone to a solids content of 30% has a viscosity of 300 cp.

Polymer 6

407.4 g (0.2396 mol) of hexanediol/neopentyl glycol polyadipate are dehydrated in a water jet vacuum at 120° C. 77.7 g (0.4625 mol) of 1,6-diisocyanatohexane are added at 70 to 80° C. and the reaction mixture is stirred for 1.5 hours at 100° C. The prepolymer has an isocyanate content of 3.4%. After the prepolymer has been dissolved in acetone to a concentration of 33%, 75.0 g (0.1924 mol) of the sodium salt of 2-aminoethyl-B-aminopropionic acid (39.5% in water) are added and the product is dispersed with 1160 mol of completely salt-free water after 7 minutes. A very finely divided dispersion is obtained after removal of the acetone by distillation in a water jet vacuum.

Data:
% $COO^-$: 1.6

% Solids content; 30 pH: 7.6
Particle size: 60 nm.

Polymer 7

650 g (0.3824 mol) of hexanediol/neopentyl glycol polyadipate and 21 g of a polyoxyethylene/polyoxypropylene (8:20) polyether which has been started on n-butanol and has a molecular weight of 2150 are dehydrated in a water jet vacuum at 120° C. After the reaction mixture has been cooled at 60° C., 125.6 g (0.7475 mol) of 1,6-diisocyanatohexane are added and the reaction mixture is heated to 100° C. and stirred at this temperature for 90 minutes. It is then cooled to 60° C. and the reaction product obtained is dissolved in 530 g of acetone. The new 60% solution contains 3.1% by weight of NCO.

To prepare the dispersions of particles used according to the invention which contain the color providing compound (dye latex), water is run into a solution of the water-insoluble, color providing compound and of the ionomeric product in a water-miscible, low boiling solvent or solvent/water mixture with stirring.

The solvent is separated from the resulting dispersion by distillation or by some other suitable separating process, such as dialysis or ultrafiltration.

According to another embodiment, the solution of the water-insoluble, color providing compound in a water-miscible, low boiling solvent may be combined with the solution of a urethane prepolymer which still contains isocyanate groups, and the polyaddition reaction may then be completed in the presence of the color providing compound. This embodiment is particularly advantageous when the color providing compound does not contain any isocyanate reactive groups.

Water-miscible organic solvents suitable for the preparation of the dispersion are capable of dissolving both the ionomeric products and the colour producing compounds. Examples of such solvents are acetone, tetrahydrofuran, dioxane, isopropanol, methanol, ethanol, methyl ethyl ketone and acetonitrile.

The quantity of color providing compound used for the preparation of the dispersion generally amounts to 2 to 200% by weight per 100% by weight of the ionomeric product. Ratios by weight of color providing compounds to ionomeric products in the range of from 1:20 to 1:1 are preferred.

This procedure enables dispersions of color providing compounds with a particle size below 150 nm to be prepared. The average particle size (diameter) is preferably in the range of from 10 to 100 nm. Particles of dispersions which have been prepared with the aid of conventional oil formers are considerably larger.

The non-diffusible color providing compound preferably used according to the invention is one which decomposes under the conditions of development in dependence upon a preceding imagewise exposure to release a diffusible dye. Such compounds will hereinafter be referred to as dye releasing compounds.

The dye releasing compounds used according to the invention may be any of numerous types of compounds which are distinguished, for example, by having a connecting link which is redox dependent in the strength of its bond and which links a dye residue to a carrier group which contains a ballast group.

A comprehensive survey of this field is given in Angew. Chem. Int. Ed. Engl. 22 (1983), 191–209, in which the most important of the known systems are described.

Particularly advantageous are the redox active dye releasing compounds corresponding to the formula

BALLAST—REDOX—DYE wherein

BALLAST: denotes a ballast group

REDOX: denotes a redox active group, i.e. a group which is oxidizable or reducible under the conditions of alkaline development and which, according to whether it is present in the oxidized or the reduced state, is capable of undergoing to varying degrees an elimination reaction, a nucleophilic displacement reaction, hydrolysis or some other splitting reaction by which the residue DYE is split off, and DYE: denotes the residue of a diffusible dye, e.g. a yellow, magenta or cyan dye, or the residue of a dye precursor.

Groups may be regarded as ballast groups if they enable the dye releasing compounds according to the invention to be incorporated in a diffusion-fast form in the hydro-philic colloids conventionally used in photographic materials. They are preferably organic groups generally containing straight chained or branched aliphatic groups with, generally, 8 to 20 carbon atoms and optionally also carbocyclic or heterocyclic, optionally aromatic groups. These ballast groups are attached to the remainder of the molecule either directly or indirectly, e.g. through one of the following groups: NHCO, $NHSO_2$, NR, wherein R stands for hydrogen or alkyl; O or S. The ballast group may in addition contain water solubilizing groups such as sulpho groups or carboxyl groups, and these may also be present in an anionic form. Since the diffusion characteristics depends on the molecular size of the whole compound used, it is in some cases sufficient, for example if the molecule as a whole is large enough, to use shorter chain groups as ballast groups.

Redox-active carrier groups having the structure BALLAST-REDOX- and appropriate dye releasing compounds are known in a wide variety of forms. A detailed description may be omitted here in view of the above-mentioned survey in Angew, Chem. Ed. Engl. 22 (1983) 191–209.

Some examples of redox-active carrier groups from which a dye residue is split off in accordance with an imagewise oxidation or reduction which has previously taken place are shown below purely for the sake of illustration:

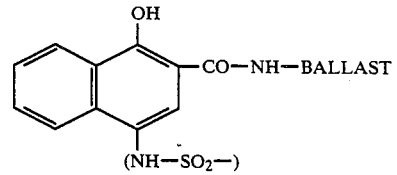

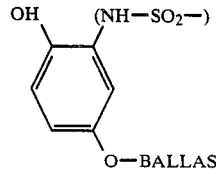

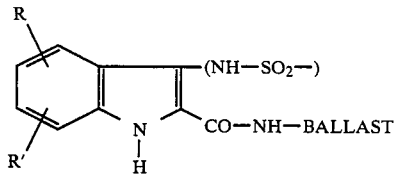

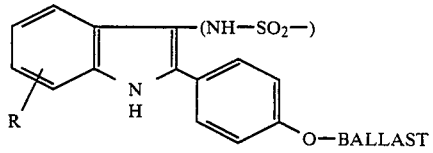

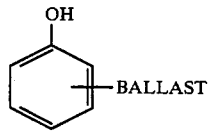

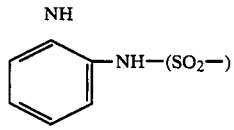

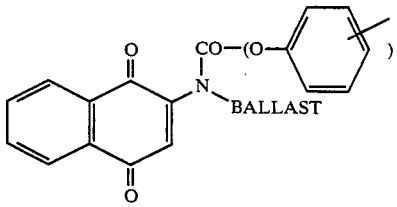

-continued

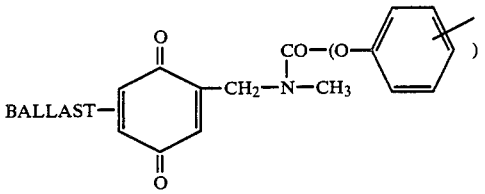

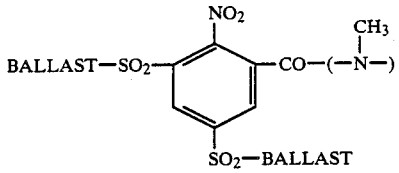

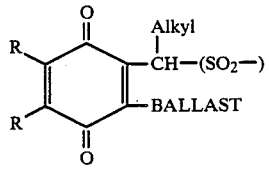

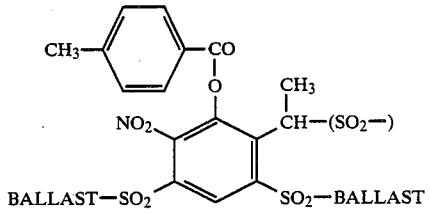

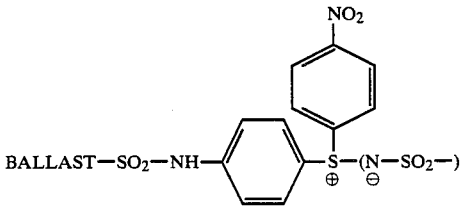

The groups in brackets are functional groups of the dye residue and are separated together with ths residue from the remaining part of the carrier group. The functional group may be a substituent which has a direct influence on the absorption and possibly also complex-forming properties of the released dye. Alternatively, the functional group may be separated from the chromophore of the dye by an intermediate or linking member, or the functional group may be of significance, possibly together with the intermediate member, in determining the diffusion and mordanting characteristics of the released dye. Examples of suitable intermediate members include alkylene groups and aryl groups.

Residues of dyes from all classes of dyes are in principle suitable as dye residues, provided they are sufficiently diffusible to be able to diffuse from the light-sensitive layer of the light-sensitive material into an image receptor layer. The dye residues may be provided with one or more alkali solubilizing groups for this purpose. Suitable alkali solubilizing groups include, inter alia, carboxyl groups, sulpho groups, sulphonamide groups and aromatic hydroxyl groups. Alkali solubilizing groups of this kind may already by preformed in the dye releasing compounds used according to the invention or they may result from the release of the dye residue from the carrier group which contains ballast groups. The following are particularly suitable dyes for the process according to the invention: Azo dyes, azomethine dyes, anthraquinone dyes, phthalocyanine dyes, indigoid dyes, triphenylmethane dyes, including dyes which are present as complexes or capable of forming complexes with metal ions.

The residues of dye precursors include residues of compounds which are converted into dyes in the course of the photographic process, in particular under the conditions of heat development, either by oxidation or by coupling or by complex formation or by release of an auxochromic group in a chromophoric system, for example by saponification. Dye precursors in this sense may be leuco dyes, couplers or dyes which are converted into other dyes in the course of processing. The latter will also be referred to below as dye residues when it is not necessary to distinguish between dye residues and residues of dye precursors.

Suitable dye releasing compounds have been described, for example, in the following documents: US Pat. Nos. 3,227,550, 3,443,939, 3,443,940, DE-A-Nos. 1 930 215, 2,242,762, 2 402 900, 2 406 664, 2,505,248, 2 543 902, 2 613 005, 2 645 656, 2 809 716, 2 823 159, BE-A-Nos. 861 241, EP-A-Nos. 0 004 399, 0 004 400, DE-A-Nos. 3 008 588, 3 014 669 and EP-A-No. 0.038 092.

The dye releasing compounds may be present as oxidizable compounds or compounds capable of coupling in some embodiments of the dye diffusion transfer process whereas in others they may be present as reducible dye releasing compounds. When conventional negatively operating silver halide emulsions are used, the copy obtained from the original is a negative or a positive, depending on whether the dye has been released from the oxidized or the reduced form of the dye releasing compound. It is therefore possible to produce either positive or negative images as desired by suitable choice of systems of dye releasing compounds.

Oxidizable dye releasing compounds particularly suitable for the colour photographic recording materials according to the invention are described, for example, in DE-A-No. 2 645 656.

If the dye releasing compound is oxidizable, it constitutes a reducing agent which is oxidized by the imagewise exposed silver halide, either directly or indirectly with the aid of electron transfer agents ETA. In that case, an imagewise differentiation in the capacity to release a diffusible dye results. If, on the other hand, the dye releasing compound is reducible, then it is advantageously used in combination with a limited quantity or reducing agent, a so-called electron donor compound or electron donor precursor compound, which in that case is present in the same layer of binder as the dye releasing compound and the light sensitive silver halide. Both the dye releasing compound and the electron donor compound may be present in the form of a dispersion of particles of an ionic product in the layer of binder, the said particles being in that case charged with the electron donor compound. The addition of electron transfer agents may also be advantageous when reducible dye releasing compounds are used in combination with electronic donor compounds.

For the production of positive colour images from positive original when negatively functioning silver halide emulsions are used, the recording material according to the invention may suitably contain, for example, reducible dye releasing compounds which have a carrier group corresponding to the following formula:

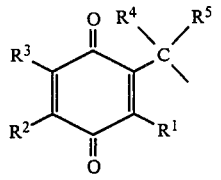

"Carquin"

wherein $R^1$ denotes alkyl or aryl;

$R^2$ denotes alkyl, aryl or a group which together with $R^3$ completes a condensed ring;

$R^3$ denotes hydrogen, alkyl, aryl, hydroxyl, a halogen such as chlorine or bromine, amino, alkylamino, dialkylamino, including cyclic amino groups (such as piperidino or morpholino), acylamino, alkylthio, alkoxy, aroxy, sulpho or a group which together with $R^2$ completes a condensed ring:

$R^4$ denotes alkyl;

$R^5$ denotes alkyl or, preferably, hydrogen, and at least one of the groups $R^1$ to $R^4$ contains a ballast group.

The electron donor compound used in combination with a reducible dye releasing compound serves as reducing agent both for the silver halide and for the dye releasing compound. Due to the fact that the silver halide and the dye releasing compound to some extent compete with each other for the oxidation of the electron donor compound and the silver halide is superior to the dye releasing compound in this respect, the areas of image within which the dye releasing compound is converted into its reduced form by the electron donor compound is determined by the silver halide present according to the imagewise exposure which has previously taken place.

Under the conditions of development, e.g. when the imagewise exposed colour photographic recording material is heated, the electron donor compound, which is present in a limited quantity, is oxidized according to the extent of exposure which has taken place and is therefore no longer available for a reaction with the dye releasing compound. An imagewise distrubution of unused electron donor compound is therefore formed.

Compounds which have been described as electron donor compounds include, for example, non-diffusible or only slightly diffusible derivatives of hydroquinone, of benzisoxazolone, of p-aminophenol and of ascorbic acid (e.g. ascorbyl palmitate) (DE-A-No. 2 809 716).

Other examples of electron donor compounds are known from DE-A-Nos. 2 947 425, 3 006 268, 3 130 842, 3 144 037, 3 217 877 and EP-A-No. 0 124 915 and from Research Disclosure No. 24 305 (July 1984). It has been found that the said electron donor compounds satisfy the requirements under the conditions of heat development and are therefore suitable as electron donor compounds for the purpose of the present invention. Particularly suitable are those electron donor compounds which are formed in the layer from the corresponding electron donor precursor compounds under the conditions of heat development, i.e. electron donor compounds which before development are only present in the recording material in a masked form in which they are virtually ineffective. These initially ineffective electron donor compounds are then converted into their active form under the conditions of heat development, for example as a result of hydrolytic removal of certain protective groups. The aforesaid electron donor precursor compounds are also regarded as electron donor compounds in the present context. In another embodiment, dye releasing compounds which are capable of coupling and release a diffusible dye as a result of a coupling reaction may be used. This covers two possibilities. In the first case, the dye is formed by chromogenic coupling by which a ballast group which inhibits diffusion is split off from the coupling position. In the other case, the coupler is non-diffusible and carries in the coupling position an already preformed dye residue as a fugitive group which is split off by the coupling reaction and thus becomes diffusible. Systems of this type have been described, for example, in US-Pat. No. 3,227,550.

Another essential component of the recording material according to the invention is the silver halide, which may consist of silver chloride, silver bromide, silver iodide or mixtures thereof and may have a particle size of from 0.02 to 2.0 μm, preferably from 0.1 to 1.0 μm. The silver halide grains may have a regular crystal structure, for example they may be cubic or octahedral, or they may have an irregular crystal structure or they may have a tabular form. In the case of mixed crystals, the silver halides may be uniformly distributed over the whole cross-section of the crystals, but the silver halide composition may also vary in different regions. Thus silver halide emulsions having a layered grain structure may be used, in which at least two layers have a different silver halide composition. Silver halide emulsions which function negatively are generally used but direct positive silver halide emulsions may also be used in other embodiments, for example as described in DE-A-Nos. 2,332,802, 2 308 239 and 2 211 728. The light-sensitive emulsion may be present as a non-sensitized silver halide or it may be chemically and/or spectrally sensitized by suitable additives, in which case the spectral sensitizer may be added before or after chemical ripening.

The quantity of light-sensitive silver halide in any given layer may be from 0.01 to 3.0 g/m$^2$ but the actual quantity will depend on the particular requirements of the reactants used and the desired effects.

As is well known, photographic recording materials which are developable by heat may in many cases contain substantially light-insensitive or at least comparatively insensitive silver salts in addition to the light-sensitive silver halide.

The addition of organic silver salts is advantageous, for example silver salts of carboxylic acids or silver salts of compounds containing an imino group. In preferred examples, these include silver salts of benzotriazole and its derivatives, e.g. silver salts of alkyl-, hydroxy-, sulpho- and/or halogen-substituted benzotriazoles.

The above mentioned essential constituents of the recording material according to the invention, namely the light-sensitive silver halide and the dye releasing compound, optionally in combination with an electron donor compound, are dispersed together in the same binder which may be hydrophobic or a hydrophilic binder but the latter is preferred. The binder used for the light sensitive layer is preferably gelatine although this may be partly or completely replaced by other natural or synthetic binders. Suitable natural binders are, for example, alginic acid and its derivatives such as its salts, esters or amides, cellulose derivatives such as carboxymethylcellulose, alkyl celluloses such as hydroxyethyl cellulose, starch and its derivatives, and carrageenates. Examples of suitable synthetic binders include polyvinyl alcohol, partially saponified polyvinyl acetate and polyvinyl pyrrolidone. Ionically modified polymers which are used according to the invention for the preparation of the dispersion of color providing compound are also suitable as binder additives (De-A-No. 3 530 156).

Examples of hydrophobic binders include polymers of polymerisable ethylenically unsaturated monomers such as alkyl acrylates, alkyl methacrylates, styrene, vinyl chloride, vinyl acetate, acrylonitrile and acrylamides. Polyesters, polyurethane compounds and waxes may also be used. Such polymers may also be used, for example, in a latex form.

The light-sensitive layer of binder contains one or more dye releasing compounds which are associated with the light-sensitive silver halide to produce monochromic colour images by releasing dyes of a particular colour. The colour finally required may therefore be obtained by producing a mixture of several such dyes and this also enables black-and-white images to be produced by means of an accurately adjusted mixture of several dye releasing compounds of different colours. For the production of multi-colour images, the colour photographic recording material of the present invention contains several, i.e. generally three associations of dye releasing compounds with silver halides sensitized to different regions of the spectrum. The range of absorption of the dye released from the dye releasing compound preferably corresponds substantially to the range of spectral sensitivity of the associated silver halide. The various associations of dye releasing compounds and silver halides may be incorporated in different layers of binder of the colour photographic material, preferably with separating layers of a water-permeable binder such as gellatine arranged between the various layers of binder. These separating layers may contain, for example, a scavenger for developer oxidation products, and they serve mainly to separate the various associations from one another to prevent falsification of the colours. In such an arrangement, the colour photographic recording material of the present invention may contain, for example, a light-sensitive layer of binder in which the silver halide is predominantly sensitive to red due to spectral sensitization and which contains a compound releasing a cyan dye, another light-sensitive layer of binder in which the silver halide is predominantly sensitive to green due to spectral sensitization and which contains a compound releasing a magenta dye, and a third light-sensitive layer of binder in which the silver halide is predominantly sensitive to blue, either due to its intrinsic sensitivity or due to spectral sensitization, and which contains a compound releasing a yellow dye.

In addition to the components mentioned above, the colour photographic recording material according to the invention may contain other components and auxiliary substances, for example for carrying out the heat treatment and colour transfer if it is recording material which can be developed by heat. These other components and auxiliary substances may be incorporated in a light-sensitive layer or in a light-insensitive layer.

The auxiliary substances used may be, for example, auxiliary developers, which generally develop exposed silver halide. In the present case, they mainly serve to promote the reactions taking place between the exposed silver halide and the reducing agent. When an oxidizable dye releasing compound is used, then this is identical to the reducing agent but when a reducible dye releasing compound is used then the reducing agent reacts with the dye releasing compound. Since this reaction consists mainly in a transfer of electrons, the auxiliary developers are also referred to as electron transfer agents ETA.

Examples of suitable auxiliary developers include hydroquinone, pyrocatechol, pyrogallol, hydroxylamine, ascorbic acid, and 1-phenyl-3-pyrazolidone and derivatives thereof, e.g. 4-methyl-1-phenyl-3-pyrazolidone, 4,4-dimethyl-1-phenyl-3-pyrazolidone, 4-hydroxymethyl-4-methyl-1-phenyl-3-pyrazolidone, 4-hydroxymethyl-4-methyl-1-tolyl-3-pyrazolidone and 4,4-dihydroxymethyl-1-phenyl-3-pyrazolidone. It is in certain cases advantageous to use these auxiliary developers in a masked form carrying a protective group which is split off in an alkaline medium. Since the auxiliary developers also exert a catalytic function, they need not be present in stoichiometric quantities. It is generally sufficient to provide them in quantities of up to ½ mold per mol of dye releasing compound in the layer. They may be incorporated in the layer by introducing them, for example, from aqueous solutions, from solutions in water-miscible solvents or as aqueous dispersions which have been prepared with the aid of oil formers.

Colour systems which undergo a coupling reaction require colour developers, for example the conventional phenylene diamine developers or aminophenols. For reasons of stability, it is advantageous to use the developer additives in a masked form with a protective group which is split off under the processing conditions.

Compounds which activate developers may also be added as auxiliary substances. These may be bases or base precursors, i.e. compounds having a pka-value of 8 or more. Suitable inorganic bases include, for example, hydroxides, tertiary phosphates, borates, carbonates of alkali metals or alkaline earth metals, and ammonium hydroxide. Examples of suitable organic bases include aliphatic amines, heterocyclic amines, amidines, cyclic amidines, guanidines and cyclic guanidines.

Base precursors are compounds which are capable of releasing a base component when heated. The compounds used for this purpose may be salts of the above-mentioned bases with organic acids which are decomposed by heat, such as trichloroacetic acid, acetoacetic acid, cyanoacetic acid, sulphonyl acetic acid or acetylene carboxylic acids. It is also advantageous to use base precursors in which the base is attached by a covalent bond and which release the base in the heat, for example by a fractionating reaction. Reference may be made in this connection to the hydroxamic acid carbamates mentioned in EP-A-O 120 402 and the aldoxime carbamates mentioned in Ep-A-O 118 078.

The auxiliary substances also include, for example, compounds which are capable of releasing water when heated. Inorganic salts containing water of crystallisation are particularly suitable for this purpose, e.g. $Na_2SO_4.10H_2O$ or $NH_4Fe(SO_4)_2.12H_2O$. The water released on heating promotes the development and diffusion processes required for the production of the image.

Auxiliary substances also include, for example, the so-called thermal solvents, which are generally organic compounds incapable of being hydrolysed and solid under normal conditions but melting when heated to the temperature for heat treatment to give rise to a liquid medium in which the development processes can take place more rapidly. Such thermal solvents may act, for example, as diffusion accelerators. Preferred examples of thermal solvents include polyglycols such as those described, for example, in US-Pat. No. 3,347,675, e.g. polyethylene glycol having an average molecular weight of from 1500 to 20,000, derivatives of polyethylene oxide, e.g. its oleic acid esters, beeswax and monotearine. Compounds which have a high dielectric constant and contain a $SO_2$ or CO group, for example, are suitable.

Reference may also be had in this connection to the thermal solvents mentioned in EP-A-No. 0 119 615, including ureas, pyridines, pyridine-N-oxides, carboxylic acid amides, imides, sulphonamides, polyhydric alcohols, oximes, pyrazoles and imidazoles.

Development accelerators may also be used as auxiliary substances, e.g. the sulphonamides described in EP-A-No. 0 160 313, and DE-A-No. 3 339 810.

Certain substances which lower the pH may also be added, mainly to stabilize the minimum densities. Suitable compounds of this type include the acid precursor compounds described, for example, in DE-A-Nos. 3 442 018 and 3 515 176.

Development of the colour photographic recording material according to the invention after imagewise exposure is initiated by carrying out a heat treatment in which the light-sensitive layer of binder is heated to a temperature e.g. in the region of from 80° to 250° C. for about 0.5 to 300 seconds. This treatment provides suitable conditions in the material for the development processes, including dye diffusion.

This treatment may be carried out under completely dry conditions, i.e. with only the moisture content present in the layers, or it may be carried out with the application, for example, of water. When development takes place, diffusible dyes are released imagewise from the dye releasing compounds and transferred to an image receptor layer which is either an integral component of the colour photographic recording material according to the invention or is brought into contact with this material at least during devlopment.

In another embodiment, development may be initiated by moistening or impregnating the colour photographic material with an alkaline processing mass which adjusts the layers of the recording material to a sufficiently high pH so that the development and colour diffusion processes can take place in the presence of suitable developer compounds which may be present in the processing mass or partly or completely in the layers of the recording material.

The image receptor layer may be arranged on the same layer support as the light-sensitive element (single sheet material) or on a separate layer support (double sheet material). It consists substantially of a binder which contains mordant for fixing the diffusible dyes released from the non-diffusible dye releasing compounds. The mordants used for anionic dyes are preferably long-chained quaternary ammonium or phosphonium compounds, e.g. those described in US-Pat. Nos. 3 271 147 and 3 271 148.

Certain metal salts and their hydroxides which form sparingly soluble compounds with acid dyes may also be used, as may also polymeric mordants such as those described in DE-A-Nos. 2 315 304, 2 631 521 or 2 941 818. Also to be included among the preferred mordants are polyvinylimidazole mordants which are not or partially quaternized, for example with benzyl-, hydroxyethyl-, alkyl-, epoxypropyl-, propyl-, methyl- and ethyl-halides. The degree of quaternization may be from 1 to 50%. The dye mordants are dispersed in the layer of mordant in one of the usual hydrophilic binders, e.g. in gelatine, poly-vinyl alcohol, polyvinylpyrrolidone or partly or completely hydrolysed cellulose esters. Some binders may, of course, themselves function as mordants, e.g. polymers of nitrogen-containing, optionally quaternary bases, such as N-methyl-4-vinylpyridine, 4-vinylpyridine or 1-vinylimidazole, as described, for example, in US-A-Pat No. 2 484 430. Other suitable mordanting binders include, for example, the quanyl hydrazone derivatives of alkylvinyl ketone polymers as described, for example, in US-Pat. No. 2 822 156, or quanyl hydrazone derivatives of acyl styrene polymers as described, for example, in DE-A-No. 2 009 498 but the last mentioned mordanting binders would generally only be used with other binders, e.g. gelatine.

If the image receptor layer is kept in layer contact with the light-sensitive element after development, an alkali permeable, light-reflecting layer of binder containing pigment is generally placed between them to provide an optical separation between the negative and the positive and serve as aesthetically pleasing image background for the transferred positive colour image.

If the image receptor layer is arranged between the layer support and the light-sensitive element and is separated from the latter by a preformed light-reflecting layer then the layer support must either be transparent so that the colour transfer image produced can be viewed through this layer or the light-sensitive element and light reflecting layer must together be removed from the iamge receptor layer to expose the latter. Alternatively, the image receptor layer may be arranged as the uppermost layer in an integral colour photographic recording material, in which case exposure is suitably carried out through the transparent layer support.

Integral layer units of light-sensitive element and image receptor element may also include stripping layers which enable the two layer elements to be separated.

The layer supports for the light-sensitive element and optionally for the image receptor element must remain dimensionally stable at the processing temperature. The usual film or paper supports may be used for this purpose. Polyester materials are preferred.

The conventional hardeners for photographic materials as well as rapid and instant hardener may be used for hardening both the light-sensitive element and the image receptor element.

EXAMPLE 1

Dye releasing compound - Latex L-1

72.7 g of Polymer P-6 were heated to 50° C. together with 545 ml of acetone, and a solution of 5.45 g of dye releasing compound MN-1 in 100 ml of acetone was added. After 15 minutes, 220 ml of water were added dropwise and the acetone was distilled off under reduced pressure in a rotary evaporator. A dye releasing compound-latex having the following data was obtained:

Solids content : 10%
Average particle size : 101 nm
Ionomer/dye releasing compound ratio: 4:1

Dye releasing compound-Latex L-2

36.4 g of Polymer P-6 and 273 ml of acetone were together heated to 50° C. and a solution of 1.37 g of dye releasing compound YN-1 in 50 ml of acetone was added with stirring. 100 ml of water were then added and the acetone was distilled off under reduced pressure. A dye releasing compound-latex having the following data was obtained:

Solid content : 10%

Average particle size : 93 nm

Ionomer/dye releasing compound ratio: 8:1.

Dye releasing compounds L-3 to L-6 were prepared analogously; see Table 1.

TABLE 1

| Dye releasing compound-latex | Dye releasing compound | Ionomer | Ionomer/dye releasing compound ratio | Particle size |
|---|---|---|---|---|
| L-3 | MN-2 | P-6 | 8:1 | 43 nm |
| L-4 | MN-3 | P-6 | 8:1 | 46 nm |
| L-5 | MN-4 | P-6 | 8:1 | 47 nm |
| L-6 | MN-5 | P-6 | 8:1 | 83 nm |

Dye releasing compound dispersions in gelatine were prepared with conventional oil formers for comparison.

A proportion of the dye releasing compound was dissolved in 3 parts of ethyl acetate together with oil former at 50° C. The resulting solution was stirred into a 10% by weight gelatine solution containing 0.5% by weight of sodium dodecylbenzene sulphonate and dispersed by means of a homogenizer for 5 minutes. The ethyl acetate was then removed under vacuum in a rotary evaporator.

The oil formers used were diethyl lauramide, palmitic acid diethylamide, dibutylphthalate and tricresylphosphate. The ratio of dye releasing compound to oil former ranged from 1/0.5 to 1/1 and the ratio of dye releasing compound to gelatine from 1/0.7 to ½. The average particle sizes of the dye releasing compound dispersions are summarized in Table 2.

TABLE 2

| Dye releasing compound dispersion | | Particle size |
|---|---|---|
| MN-1/diethyl lauramide | 1/0.5 | 354 nm |
| MN-2/diethyl lauramide | 1/0.5 | 320 nm |
| MN-3/diethyl lauramide | 1/0.5 | 305 nm |
| MN-4/tricresylphosphate | 1/1 | 263 nm |

It may be seen that, as required, the particle size of the dye releasing compound latices according to the invention is much finer than in conventionally prepared dye releasing compound dispersions.

Dye releasing compounds, summary of formulae

MN-1

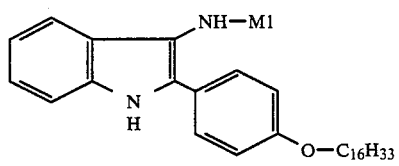

MN2

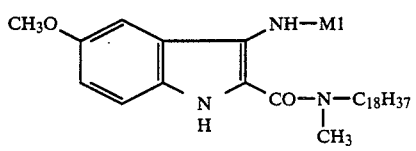

MN-3

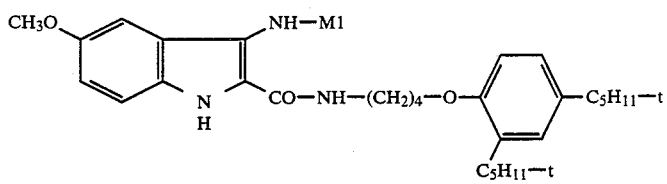

MN-4

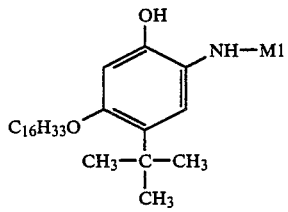

MN-5

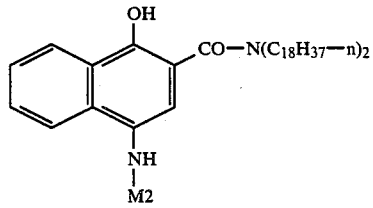

-continued

M1

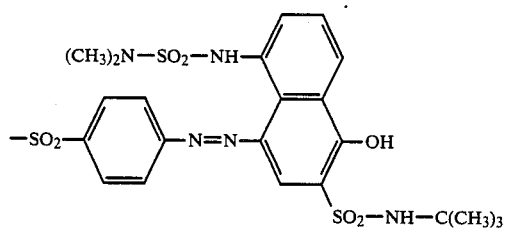

M2

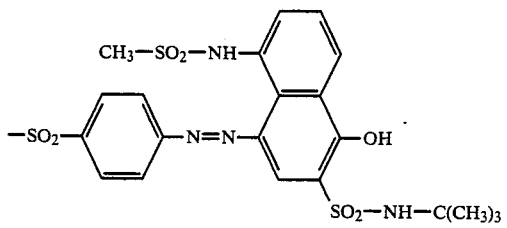

YN-1

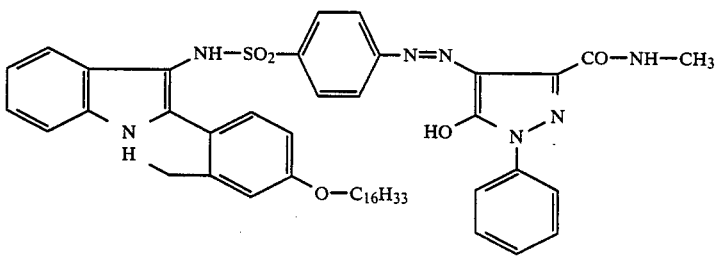

EXAMPLE 2

A light-sensitive element of a photothermographic recording material was prepared by application of the layers described below to a transparent layer support of polyethylene terephthalate. The quantities given refer to 1 $m^2$.

Layer 1

A layer containing a green-sensitized gold/sulphur-ripened silver halide emulsion of 0.5 g of $AgNO_3$ (4 mol-% of AgCl, 88.7 mol-% of AgBr, 7.3 mol-% of AgI, average grain diameter 0.3 um) with 0.005 g of 2-mercapto-5-sulphobenzimidazole, 0.05 g of potassium bromide, 0.3 g of dye releasing compound MN-1 (emulsified in 0.15 g of diethyl lauramide) and 1.5 g of gelatine.

Layer 2

A layer containing 1.5 g of guanidinium trichloroacetate, 0.035 g of 4-methyl-4-hydroxymethyl-1-phenyl-3-pyrazolidone, 0.008 g of sodium sulphite, 0.5 g of compound SC, 0.03 g of compound WA and 1.5 g of gelatine.

Layer 3

A protective layer containing 0.5 g of gelatine.

The hardener was applied together with this protective layer.

The light-sensitive element prepared as described above was marked Sample 1. Samples 2 to 4 were prepared similarly but in layer 1 the diethyl lauramide used as oil former was replaced by an equal quantity of the oil formers indicated: palmitic acid diethylamide, dibutylphthalate or tricresyl phosphate. Samples 1 to 4 served as Comparison samples. Another sample contained the additive according to the invention and was marked Sample 5. It was prepared by a similar method but in Layer 1 the dye releasing compound MN-1 was used as dye releasing compound-latex L-1.

Compound SC

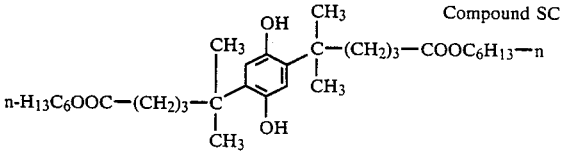

Compound WA

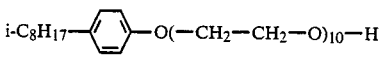

An image receptor element for the photothermographic recording material was prepared by applying the following layers in succession to a layer support of polyethylene coated paper. The quantities given are based on 1 $m^2$.

Layer 1

A mordant layer containing 3 g of poly[1-vinylimidazole-co-1-vinyl-3-(3'-4'-dichlorobenzyl)-imidazolium-chloride] and 3 g of gelatine.

Layer 2

A covering layer containing 1.9 g of gelatine.

Layer 3

A hardening layer containing 0.35 g of dimethylolurea and 1 g of gelatine.

Processing

One sheet of each light-sensitive element (Samples 1 to 5) was exposed through a step wedge. Development was carried out in two stages. In the first stage, the light-sensitive element was heated to 120° C. for 60 seconds by means of a heating plate on which the sample was placed with its active side in contact with the plate and covered with another plate. In the second step, the sample was placed with its active side in contact with the image receptor element which had previously been impregnated with water. The resulting set was treated for 2 minutes at 70° C. by the method described for the first step. During this time, colour transfer took place from the light-sensitive element to the image receptor element. The two layer element were then separated. A magenta negative image of the exposed original was obtained on the image receptor element.

The results of development of Samples 1 to 5 are summarized in Table 1. The density values given were measured behind a green filter.

TABLE 3

| Sample | $D_{min}/D_{max}$ |
|---|---|
| 1 | 0.38/0.86 |
| 2 | 0.26/0.72 |
| 3 | 0.23/0.67 |
| 4 | 0.27/0.87 |
| 5 | 0.16/2.11 |

As may be seen from Table 3, Sample 5 containing the latex L-1 according to the invention shows a marked increase in maximum densities with a much lower level of fogging than comparison Samples 1 to 4 which have been prepared with conventional oil formers.

EXAMPLE 3

Layer 1

A layer containing a silver halide emulsion of 0.5 g of $AgNO_3$ (20 mol-% AgCl, 80 mol-% AgBr, average grain diameter 0.8 μm) which has been blue-sensitized and chemically ripened with sulphur, containing 0.005 g of 2-mer-capto-5-sulphobenzimidazole, 0.4 g of dye releasing compound YN-1 (emulsified in 0.2 g of diethyl lauramide), 0.02 g of potassium bromide and 1 g of gelatine.

Layers 2 and 3 were identical to layers 2 and 3 of Example 2.

This arrangement of layers was marked Sample 6 and served as Comparison sample. Another sample, marked 7, contained the dye releasing compound-latex L-2 according to the invention.

Processing was carried out by a method analogous to that of Example 2 but the time for the first process step was 50 seconds. The results of development of the yellow dye diffusion images measured behind a blue filter are summarized in Table 4.

TABLE 4

| Sample | $D_{min}/D_{max}$ |
|---|---|
| 6 | 0.27/0.52 |
| 7 | 0.26/2.11 |

As may be seen from Table 4, the development results with the additive according to the invention show above all a marked improvement in maximum density compared with the Comparison sample.

EXAMPLE 4

Example 2 was repeated but in this case the dye releasing compound dispersions shown below were used in Layer 1. The following layer samples were obtained:

Sample 8 containing 0.3 g of dye releasing compound MN-2 emulsified in 0.15 g of diethyl lauramide, Sample 9 containing 0.3 MN-2 as latex L-3, Sample 10 containing 0.3 g of dye releasing compound MN-3 emulsified in 0.15 g of diethyl lauramide, Sample 11 containing 0.3 g of MN-3 as latex L-4, Sample 12 containing 0.3 g of dye releasing compound MN-4 emulsified in 0.3 g of tricresylphosphate, Sample 13 containing 0.3 g of MN-4 as latex L-5.

Samples 8, 19 and 12 served as Comparison samples and Samples 9, 11 and 13 contained the dye releasing compound latices according to the invention. Processing was carried out as described in Example 2. The results of development are summarized in Table 5. The colour densities were measured behind a green filter.

TABLE 5

| Samples | $D_{min}/D_{max}$ |
|---|---|
| 8 | 0.27/0.49 |
| 9 | 0.25/1.57 |
| 10 | 0.15/0.18 |
| 11 | 0.16/0.63 |
| 12 | 0.35/0.44 |
| 13 | 0.35/1.03 |

This example again demonstrates the marked improvement in maximum densities obtained with the dye releasing compound-latices according to the invention compared with conventionally prepared dye dispersions.

EXAMPLE 5

The fogging behaviour of a dye releasing compound-latex was tested in a layer arrangement without silver halide under conditions of processing in the heat compared with a conventional dye releasing compound dispersion.

Layer 1

A layer containing an emulsion of 0.3 g of dye releasing compound MN-1 in 0.15 g of diethyl lauramide, 0.06 g of compound SC and 1 g of gelatine.

Layer 2

A layer containing 0.3 g of compound SC, 0.035 g of 4-methyl-4-hydroxymethyl-1-phenyl-3-pyrazolidone and 0.8 g of gelatine. The hardener was applied at the same time as this layer.

The resulting material was marked Sample 14 and served as Comparison sample. Another sample 15 was prepared similarly but in this case the dye releasing compound-latex L-1 was used in layer 1.

An image receptor element was prepared by applying the following layers in succession to a layer support of polyethylene coated paper.

Layer 1

A mordant layer containing 2 g of polyurethane mordant (obtained from 4,4'-diphenylmethane diisocyanate and N-ethyl-diethanolamine quaternized with epichlorohydrin according to DE-A-2 631 521, Example 1), 0.035 g of compound WA and 2 g of gelatine.

Layer 2

A layer containing 2 g of guanidinium carbonate, 0.007 g of compound WA and 1 g of gelatine.

Layer 3

An interlayer containing 1 g of gelatine

Layer 4

A hardening layer containing 0.5 g of dimethylolurea and 1 g of gelatine.

Processing was carried out as follows:

Samples 14 and 15 were briefly dipped in water and then heated to 90° C. with their active surface in contact with the iamge receptor element. The two sheets were then separated. The fogging values after different contact times were measured. The results, measured behind green filters, are listed in Table 6.

TABLE 6

| Sample | Process | $D_{min}$ |
|---|---|---|
| 14 | 30 s/90° C. | 0.13 |
| 14 | 60 s/90° C. | 0.17 |
| 14 | 120 s/90° C. | 0.21 |
| 15 | 30 s/90° C. | 0.11 |
| 15 | 60 s/90° C. | 0.11 |
| 15 | 120 s/90° C. | 0.12 |

This example shows that when the dye releasing compound-latex according to this invention is used in heat processing, fogging is also reduced from the amount of heat applied.

We claim:

1. A photographic recording material having at least one supported layer of binder containing a light sensitive silver halide and at least one non-diffusible color providing compound capable of releasing a diffusible dye upon development, said color providing compound being contained in the binder layer in the form of a dispersion of particles of an ionically modified polymer which is charged or loaded with the color providing compound wherein the ionically modified polymer is an ionomeric polyaddition or polycondensation product containing from 4 to 180 milliequivalents of ionic groups per 100 g and is selected from the group consisting of polyurethanes, polyesters, polyamides, polyureas, polycarbonates, polyacetals, polyethers and ionomeric products belonging to two or more types thereof.

2. Recording material according to claim 1, characterised in that the dispersion has an average particle size of less than 150 nm.

3. Recording material according to claim 1, characterised in that the ionically modified polymer is a polyurethane which may contain ether, ester and/or urea structures.

4. Recording material according to claim 3, characterised in that the ionically modified polymer contains from 1 to 20% by weight of alkylene oxide units in the form of a polyether chain.

5. Recording material according to claims 1,3,4 or 2, characterised in that the color providing compound is a redox active dye releasing compound.

6. Recording material according to claims 1,3,4 or 2, characterised in that it is developable by heat treatment.

7. Recording material according to claim 6, characterised in that it contains in one of its layers a compound which is alkaline in action under the processing conditions.

* * * * *